US005529033A

United States Patent [19]

Hampton

[11] Patent Number: 5,529,033

[45] Date of Patent: Jun. 25, 1996

[54] MULTIPLE ROCKER ARM VALVE CONTROL SYSTEM

[75] Inventor: Keith Hampton, Ann Arbor, Mich.

[73] Assignee: Eaton Corporation, Cleveland, Ohio

[21] Appl. No.: 452,232

[22] Filed: May 26, 1995

[51] Int. Cl.[6] ..... F01L 13/00; F01L 1/18

[52] U.S. Cl. ..... 123/90.16; 123/90.41; 123/90.43

[58] Field of Search ..... 123/90.15, 90.16, 123/90.17, 90.27, 90.39, 90.41, 90.43, 90.44, 90.45, 90.46

[56] References Cited

U.S. PATENT DOCUMENTS

| | | | |
|---|---|---|---|
| 4,151,817 | 5/1979 | Mueller | 123/90.16 |
| 4,203,397 | 5/1980 | Soeters, Jr. | 123/198 F |
| 4,726,332 | 2/1988 | Nishimura | 123/90.16 |
| 4,762,096 | 8/1988 | Kamm et al. | 123/198 F |
| 4,768,475 | 9/1988 | Ikemura | 123/90.16 |
| 5,280,770 | 1/1994 | Satou et al. | 123/90.16 |
| 5,297,516 | 3/1994 | Hara | 123/90.16 |

FOREIGN PATENT DOCUMENTS

| | | | |
|---|---|---|---|
| 83/1483 | 4/1983 | WIPO | 123/90.16 |
| 83/4070 | 11/1983 | WIPO | 123/90.16 |

*Primary Examiner*—Weilun Lo
*Attorney, Agent, or Firm*—Frank M. Sajovec

[57] ABSTRACT

A valve control system for an internal combustion engine. The system includes an outer rocker arm which is engageable with an engine poppet valve, and an inner rocker arm which is engageable with a cam lobe formed in the engine camshaft. The rocker arms are moveable axially relative to one another between a first position wherein the inner rocker arm engages the outer rocker arm to transmit a valve opening force from the camshaft to the poppet valve, and a second position wherein the inner and outer rocker arms are out of engagement and free to rotate relative to one another. The system is adapted for use in a valve train wherein the poppet valve remains closed when the inner and outer rocker arms are in their second position or in a valve train wherein the popper value is opened in response to a first cam lobe profile when the inner and outer rocker arms are in their first position and in response to a second cam lobe profile when they are in their second position.

10 Claims, 3 Drawing Sheets

MULTIPLE ROCKER ARM VALVE CONTROL SYSTEM

The present invention relates to valve operating apparatus for an internal combustion engine and, more particularly, to apparatus to vary the operational characteristics of intake or exhaust valves in such engines during various operational modes of the engine.

Variable valve control systems for multiple valve engines wherein the intake and/or exhaust valves can either be selectively actuated or actuated at selected lift profiles, are well known in the art. One known system is shown in U.S. Pat. No. 4,151,817, which discloses a primary rocker arm element engageable with a first cam profile, a secondary rocker arm element engageable with a second cam profile, and means to interconnect or latch the primary and secondary rocker arm elements.

It is an object of the present invention to provide such a system which is less expensive to manufacture, has improved response, requires less operating force and has a longer useful life than prior art systems.

The present invention meets the above objective by providing a latchable rocker arm assembly which includes an outer rocker arm which engages the engine valve, and an inner rocker arm received within the outer arm and having a roller mounted thereon which contacts a primary cam lobe. The inner and outer rocker arms are movable relative to one another between an active or latched condition wherein a contact surface on the inner arm engages the outer arm to transmit the cam force from the inner arm to the outer arm to apply an opening force to the valve, and an inactive or unlatched condition wherein the contact surface of the inner arm does not engage the outer arm and no opening force is transmitted to the valve. The inner and outer rocker arms are both pivotally mounted on the output member of a stationary hydraulic lash adjuster, and the outer rocker arm has a secondary cam follower element formed thereon which engages a secondary or base circle cam lobe element formed on the camshaft when the assembly is in its inactive condition to maintain a force acting against the combined spring and hydraulic force applied to the output member of the lash adjuster to prevent over extension or "pump up" of the lash adjuster when the primary cam lobe is in its base circle phase.

It will be appreciated that the system of the present invention can also be employed in an application wherein the secondary cam follower element on the outer arm is contacted by a cam lobe having a lower lift profile than the primary cam lobe, whereby, when the inner and outer rocker arms are in the unlatched condition the low lift cam acting directly on the outer arm is effective to open the valve in accordance with a first cam profile and when the inner and outer arms are in the latched condition the high lift cam is operable to open the valve in accordance with the second cam profile.

Other objects and advantages of the invention will be apparent from the following description when considered in connection with the accompanying drawings, wherein.

Figure 2:
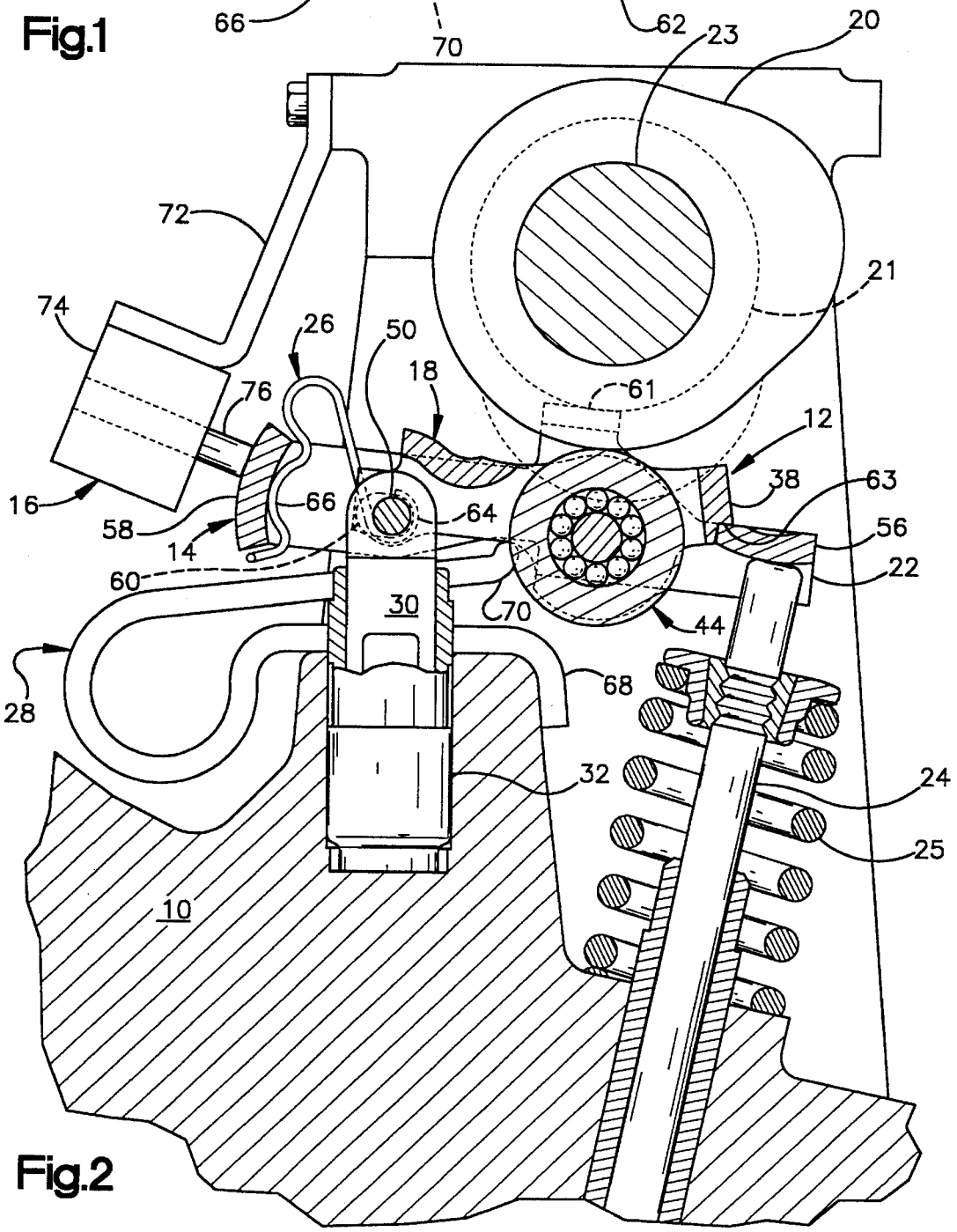
FIG. 2 is a sectional view taken along line 2—2 of FIG. 1.

Referring primarily to FIG. 2, there is illustrated a portion of the cylinder head 10 of an internal combustion engine of the overhead cam type which incorporates the valve control system 12, of the invention. As illustrated herein, the control system 12 is of the type which is particularly adapted to selectively actuate or deactuate an engine valve and comprises a rocker arm assembly 14 which is shiftable between an active or latched mode wherein it is operable to open the valve, and an inactive or unlatched mode wherein the valve is not opened; and an actuator assembly 16 which is operable to shift the rocker arm assembly between its active and inactive modes.

The rocker arm assembly 14 comprises an inner arm assembly 18 which is engageable with a primary cam lobe 20 formed on a camshaft 23, an outer arm 22 which is engageable with one or more secondary cam lobes 21 and with a poppet valve 24 which is maintained normally closed by a spring 25, a spring 26 which acts between the inner and outer arms to bias the outer rocker arm into its latched condition and a second spring 28 which biases the inner rocker arm assembly 18 into engagement with the cam. In the preferred embodiment of the invention the inner arm 18 and outer arm 22 are pivotally mounted for rotation on the output plunger 30 of a stationary hydraulic lash adjuster 32 received in the cylinder head 10. The construction and the function of the lash adjuster 32 are well known and will not be described in detail herein.

To provide a better understanding of the relationship between the inner and outer rocker arms, reference is made to the details of these components in FIGS. 3–8.

Figure 3:
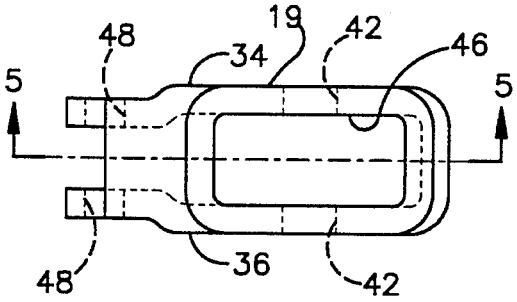
FIG. 3 is a plan view of a first rocker arm of the invention.
Figure 4:
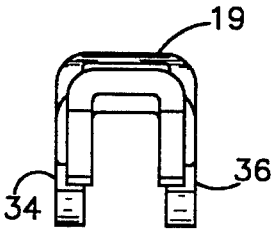
FIG. 4 is an end elevation view of the rocker arm of FIG. 3.
Figure 5:
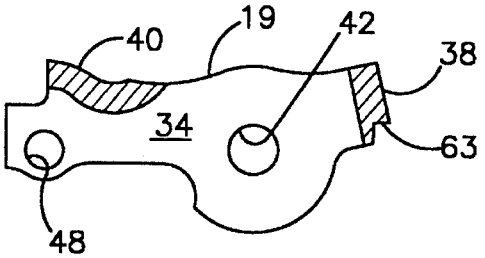
FIG. 5 is a section view taken along line 5—5 of FIG. 3.

Referring to FIGS. 3, 4 and 5, the inner arm assembly 18 comprises a stamped arm member 19 which is of inverted U-shape in end elevation, having spaced apart leg sections 34 and 36, a contact element 38 formed at one end, and a horizontal spine section 40 formed adjacent the other end. Aligned bores 42 are formed in the legs 34 and 36 to receive the axle of a needle roller assembly 44 (see FIG. 2). An opening 46 is formed to provide clearance for the roller. As will be described in more detail below, the contact element 38 defines a latch surface which interacts with the outer arm 22 when the arms are in a latched condition. Aligned bores 48, are formed in the legs 34, 36 adjacent the end opposite the contact element to receive an axle 50 (see FIG. 2) pivotally mounting the arm assembly 18 on the plunger 30.

Figure 6:
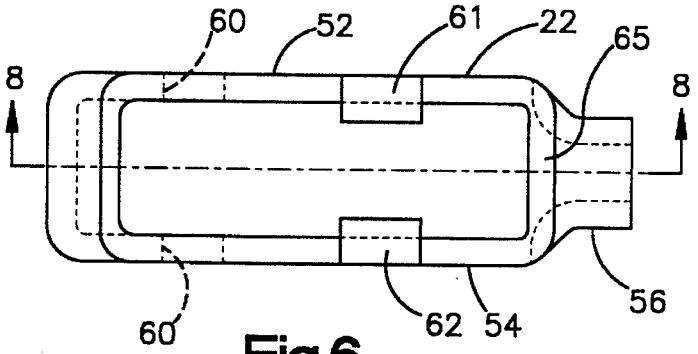
FIG. 6 is a plan view of a second rocker arm of the invention.
Figure 8:
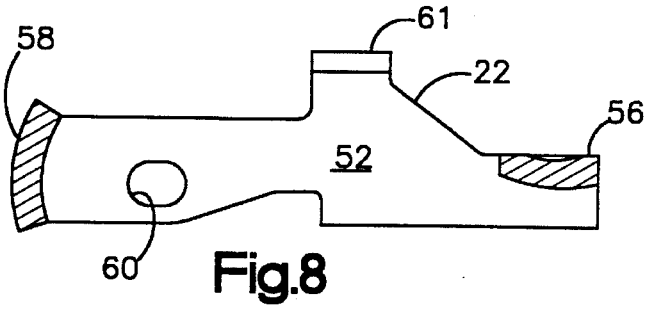
FIG. 8 is a section view taken along line 8—8 of FIG. 6.
Figure 7:
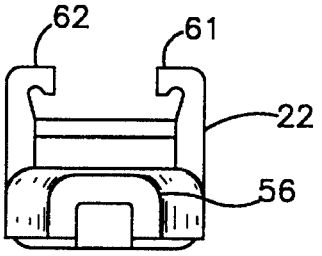
FIG. 7 is an end elevation view of the rocker arm of FIG. 6.

Referring to FIGS. 6, 7 and 8, the outer arm 22 is a generally rectangular member in plan view having spaced apart side walls 52 and 54 a first end 56 which is formed as an inverted U in elevation to define a cam contacting element, and a second end which is formed as a curved wall 58 which defines an actuator contact surface as will be described below. Elongated bores 60 are formed through the walls 52 and 54 to receive the axle 50, the bores 60 being elongated to permit axial movement of the outer arm relative to the inner arm when the rocker arm assembly is shifted between its latched and unlatched conditions. As will be described in more detail below, secondary cam follower surfaces 61, 62 are formed on upwardly extending portions of the side walls 52, 54 for engagement with secondary cam lobes 21 formed on the camshaft 50.

Figure 1:
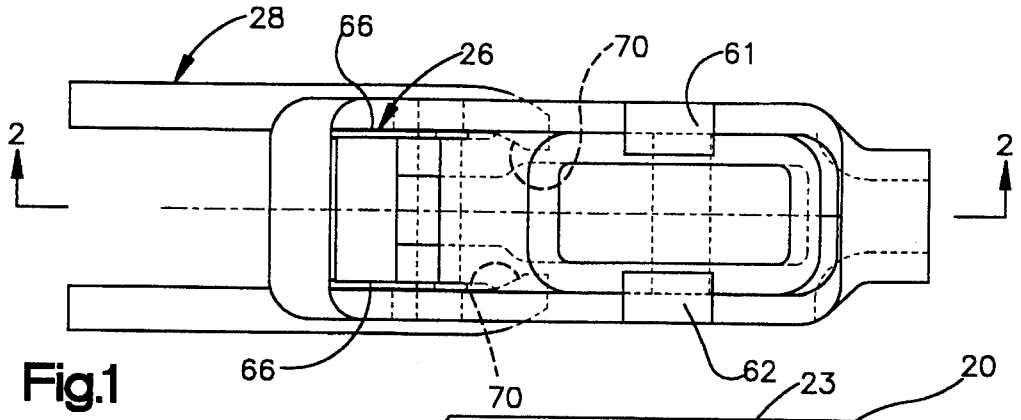
FIG. 1 is a partial plan view of the invention, with parts removed for clarity.
Figure 9:
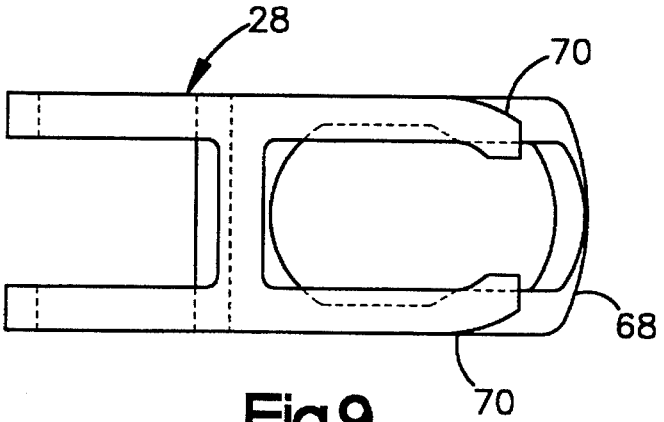
FIG. 9 is a plan view of a spring used in the invention.

Referring again to FIG. 2, the needle roller assembly 44 is mounted within the opening 46 in the inner arm 18 with its axle received within the bores 42. The inner arm assembly is received between the walls 52, 54 of the outer arm and the arm assembly 14 is positioned over the plunger 30 with the bores 48 and 60 aligned with a bore formed in the plunger to receive the axle 50. The outer arm, by virtue of the elongated bores 60, is free to move along its longitudinal axis relative to the inner arm, between a first position in which the outer arm 22 is moved to the left relative to the inner arm 18, as shown in FIG. 2, wherein a ledge 63 formed on the contact element 38 of the inner arm will contact a surface 65 formed adjacent the first end 56 of the outer arm when the inner arm is rotated relative to the outer arm to the position shown in FIG. 2; and a second position in which the outer arm is moved to the right wherein the ledge 63 does not engage the outer arm. The inner and outer arms are normally biased into the first or latched position by means of the spring 26, which is a hairpin type spring which acts between the axle 50 and the end wall 58 of the outer arm, having one pair of legs 64 looped over the axle and the second pair 66 bearing against the wall 58. The second spring 28, also a hairpin type spring, has a first end 68 fixed (not shown) to the cylinder head 10 and a pair of legs 70 which project inwardly as shown in FIGS. 1 and 9 so that they engage the legs 34, 36 of the inner arm to bias the inner arm counterclockwise, as shown in FIG. 2, about the axle 50 to maintain the roller assembly 44 in engagement with the cam lobe 20.

The internal plunger spring (not shown), along with the hydraulic force of the lash adjuster 32 maintains the secondary cam follower surfaces 61, 62 on the outer arm in engagement with the secondary cam lobes 21, which in the FIG. 2 embodiment define a base circle cam profile. Any clearance which tends to develop between the valve and the outer arm is taken up by the lash adjuster.

As indicated above, the rocker arm assembly 14 is normally biased into its latched condition. In this condition the inner arm assembly 18 is in a position relative to the outer arm wherein the ledge 63 on the inner arm contacts the surface 65 of the outer arm when the primary cam lobe is rotated to the broken line position shown in FIG. 2, the cam force being transmitted through the roller 44 and the inner and outer arms to the valve.

To shift the assembly from its latched condition to its unlatched condition, the outer arm 22 is moved to he right relative to the inner arm 18 as shown in FIG. 2, against the force of spring 26, putting the outer arm in a position wherein the surface 65 will not be engaged by the contact element 38 of inner arm. In this condition the force of the cam 20 against the inner arm is not transmitted to the outer arm and the valve 24 remains in its closed position; however, since the secondary cam follower surfaces 61, 62 are maintained in engagement with the secondary cam lobes 21, there will be no tendency for the lash adjuster to pump up when the system is in the unlatched condition.

In the illustrated embodiment, the actuator assembly 16 is shown somewhat schematically since a variety of linear actuating arrangements can be used to shift the position of the outer arm, and the actual arrangement employed will depend on space and mounting limitations associated with a particular engine in which the system is installed. As illustrated herein the assembly comprises a bracket member 72 fixed to the cylinder head and a solenoid 74 having an output member 76 which bears against the outer surface of end wall 58 to move the outer arm to the unlatched position as described above.

Figure 12:
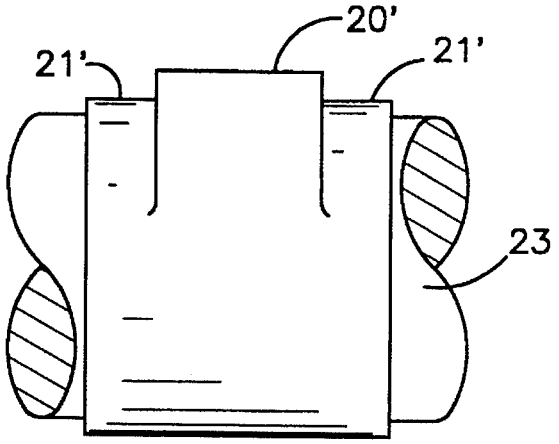
FIG. 12 is a side elevation view of the cam lobe arrangement of FIG. 11.
Figure 10:
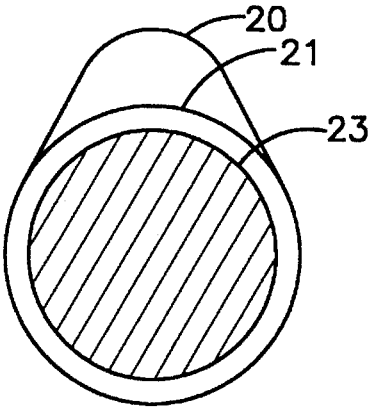
FIG. 10 is an end elevation view of a first cam lobe arrangement used in connection with the invention.
Figure 11:
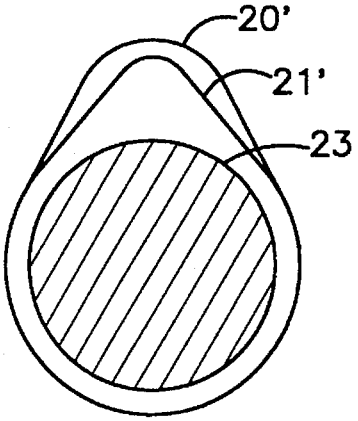
FIG. 11 is an end elevation view of a second cam lobe arrangement used in connection with the invention.

The invention has been described herein as a system wherein the valve 24 is either opened by the primary cam lobe 20 or remains closed. The system can also be used in a valve train system wherein the secondary or base circle cam lobes 21 are replaced by active low lift cam lobes 21' as illustrated in FIGS. 11 and 12, and wherein the primary cam lobe 20 is replaced by a high lift cam lobe 20'. In this configuration, when the system is in its latched condition as shown in FIG. 2, the high lift lobe 20' will be effective to open and close valve 24 in accordance with its lift profile as described above. When the outer arm 22 is shifted to the right by the actuator 16, the high lift cam lobe 20' will be rendered ineffective as described above; however, the low lift cam lobes 21' acting on the secondary cam follower surfaces 61, 62 on the outer arm will be effective to open and close the valve 24 in accordance with the lift profile of the low lift cam lobes 21'.

I claim:

1. A valve control system for an internal combustion engine including a cylinder head; a poppet valve movable within said cylinder head between an open and closed condition; and a camshaft having a first cam lobe having a first cam profile formed thereon; said control system comprising a first rocker arm mounted on said cylinder head for rotation about an axis and engageable with said popper valve; a second rocker arm mounted on said cylinder head for rotation about said axis and having a first cam follower element thereon engageable with said first cam lobe; and means for imparting relative movement between said first and second rocker arms in a direction perpendicular to said axis between a first position wherein said first and second rocker arms are in mutual engagement for rotation in unison about said axis and a second position wherein said first and second rocker arms are free to rotate relative to one another.

2. Apparatus as claimed in claim 1 wherein said first and second rocker arms are mounted for rotation on an axle perpendicular to the longitudinal axes of said rocker arms, said first rocker arm being mounted on said axle for limited linear movement in a direction parallel to the longitudinal axis of said first rocker arm, and wherein said means for imparting relative movement comprises means for moving said first rocker arm in said direction.

3. Apparatus as claimed in claim 2, including means biasing said first and second arms into said first position.

4. Apparatus as claimed in claim 2, including a hydraulic lash adjuster mounted on said cylinder head, said axle being received in an output member of said lash adjuster.

5. Apparatus as claimed in claim 4 in which said first rocker arm has a second cam follower element formed thereon, said second cam follower element being engageable with a second cam lobe on said camshaft having a second cam profile formed on said camshaft.

6. Apparatus as claimed in claim 5 in which said first cam profile has higher lift characteristics than said second cam profile, said first rocker arm being operable to open said valve ,when said first and second rocker arms are in the second position in response to engagement of said second cam follower element with said second cam lobe; and said first rocker arm being operable to open said valve when said first and second rocker arms are in said first position in response to engagement of said first cam follower element with said first cam lobe.

7. Apparatus as claimed in any one of claims 1 through 6, including means biasing said second rocker arm into engagement with said first cam lobe.

8. Apparatus as claimed in claim 2, in which said first rocker arm is an elongated rectangular structure having opposed side walls, a first end having a first end wall formed thereon, a second end having a valve engagement surface formed thereon, and a first contact surface formed thereon; and said second rocker arm comprises an elongated rectangular structure received between the opposed side walls of said first rocker arm, said second rocker arm having a second contact surface formed thereon engageable with said first contact surface when said first and second rocker arms are in said first position.

9. Apparatus as claimed in claim 8, including a roller mounted on said second rocker arm, said roller defining said first cam follower element.

10. Apparatus as claimed in claim 9, including a first bore formed in said second rocker arm to receive said axle, and a second bore formed through said side walls of said first rocker arm to receive said axle, said second bore being elongated in a direction parallel to the longitudinal axis of said first rocker arm.

* * * * *